United States Patent [19]

Doering

[11] 4,199,015

[45] Apr. 22, 1980

[54] LOG SPLITTER

[75] Inventor: Charles W. Doering, New Albany, Ind.

[73] Assignee: Brinly-Hardy Co., Inc., Louisville, Ky.

[21] Appl. No.: 915,561

[22] Filed: Jun. 14, 1978

[51] Int. Cl.[2] ..... B27L 7/00

[52] U.S. Cl. ..... 144/193 A; 125/23 R; 144/193 R

[58] Field of Search ..... 144/193 R, 193 A, 193 C, 144/3 K, 323, 193 K; 254/104, 124; 125/23 R, 23 C

[56] References Cited

U.S. PATENT DOCUMENTS

| | | | |
|---|---|---|---|
| 195,651 | 9/1877 | Roelecke | 144/193 R |
| 280,657 | 7/1883 | Mors et al. | 144/193 K |
| 508,020 | 11/1893 | Ivey | 144/193 K |
| 827,251 | 7/1906 | Melton | 144/193 C |
| 1,191,176 | 7/1916 | Harber | 144/193 C |
| 3,760,854 | 9/1973 | Worthington | 144/193 A |
| 4,061,168 | 12/1977 | Fariss, Jr. | 144/193 R |
| 4,086,111 | 4/1978 | Corey | 144/193A |
| 4,112,985 | 9/1978 | Gosselin | 144/193 A |

*Primary Examiner*—Travis S. McGehee
*Assistant Examiner*—W. D. Bray
*Attorney, Agent, or Firm*—Frank C. Leach, Jr.

[57] ABSTRACT

A log splitter includes vertical support means, which is preferably pivotally mounted on the ends of a three point tractor hitch, having a pivotally mounted support adjacent its bottom for supporting the bottom of a log to be split. The pivotally mounted support is attached to a tractor drawbar in one embodiment. A splitting wedge is mounted on the upper end of the vertical support means and retained against upward movement by spring biased pawls engaging ratchet tracks on the vertical support means. When the vertical support means is lifted by the tractor hitch, the pivotally mounted support raises the bottom of the log relative to the vertical support means so that the log is driven into the wedge and split. When upward movement of the vertical support means by the tractor hitch has been completed, the vertical support means is returned to its start position. During this downward movement, the wedge remains wedged in the log and the pawls enable downward movement of the wedge with the log. During the next upward movement of the vertical support means, the wedge is driven further into the log. The splitting cycles continue until the log is split. If desired, the pivotally mounted support can be moved by a hydraulic cylinder whereby the pivotally mounted support would not be connected to the tractor drawbar. With the hydraulic cylinder, the vertical support means could remain attached to the tractor hitch, which would not be moved, or could be mounted on a separate carrier.

8 Claims, 14 Drawing Figures

LOG SPLITTER

Logs must be split in order to be effectively used economically as fire wood. Various types of powered log splitters have previously been suggested.

One prior log splitter has supported the log at its bottom on a platform and moved a pivotally mounted splitting wedge into the top of the log to cause splitting thereof. The pivoting of the wedge is accomplished by a hydraulic cylinder.

This prior log splitter requires an adjustment of the platform for the length of the log. That is, it is necessary to adjust the platform each time for different length logs.

Furthermore, the pivoting of the splitting wedge of the prior log splitter is limited to a predetermined arc. Thus, if the log does not split during the first pivotal movement, the second pivotal movement of the wedge is in the same arc so as to not produce any further movement of the wedge into the log. Additionally, the splitting wedge must move through the area in which it has already split the log during the previous cycle or cycles.

Since the force required to split a log varies substantially depending upon the type of wood, the diameter and length of the log, any knots in the log, and moisture therein, the prior pivoting type of log splitter is not necessarily satisfactory under all conditions.

The log splitter of the present invention satisfactorily overcomes the foregoing problems of the prior log splitter. With the log splitter of the present invention, it is only necessary to dispose the splitting wedge on the top of the log being split irrespective of the log's length and then to begin the splitting operation.

The log splitter of the present invention enables any length of log to which a log is cut for fire wood to be split. This is because the splitting wedge is retained in the log in the position to which it is advanced in one splitting cycle at the start of the next splitting cycle. Therefore, there is no difficulty in having to withdraw the splitting wedge and then return it into the log.

Additionally, by retaining the wedge in the position to which it has been advanced during the prior splitting cycle, there is a reduction in the amount of travel of the support for the bottom of the log being split during the next splitting cycle.

Since the amplification of the force applied to the log varies during the lifting of the bottom of the log towards the splitting wedge and decreases as the bottom of the log is moved upwardly towards the splitting wedge, the retaining of the splitting wedge in the position to which it is advanced during one splitting cycle enables the higher force amplification to be utilized for splitting of the log during the next splitting cycle. This is because the high amplification of the force at the start of the cycle is being applied with the wedge already in position to cause further splitting. Therefore, the number of splitting cycles to split a specific log is reduced in comparison with the prior log splitter.

In the preferred embodiment, the log splitter of the present invention is mounted on a three point tractor hitch with the movement of the support for the bottom of the log being produced by the support being pivotally and slidably connected to a drawbar of the tractor so as to be moved upwardly with respect to the splitting wedge as the log splitter is raised and pivoted by the three point tractor hitch. Thus, in this embodiment, no hydraulic cylinder is required as in the prior log splitter.

Therefore, in the preferred embodiment, the log splitter of the present invention may be readily utilized with a tractor without requiring any additional hydraulic cylinder.

In other embodiments, a hydraulic cylinder lifts the movable support at the bottom of the log being split toward the splitting wedge to cause splitting of the log. This hydraulic cylinder can receive pressurized fluid from a tractor if the log splitter is mounted on a tractor. If the log splitter is mounted on a separate carrier, then suitable means must be provided to supply the hydraulic fluid under pressure to the hydraulic cylinder.

An object of this invention is to provide a unique log splitter.

Another object of this invention is to provide a log splitter for use with a tractor.

A further object of this invention is to provide a log splitter in which the maximum force for splitting is effective to cause splitting during each splitting cycle.

Other objects of this invention will be readily perceived from the following description, claims, and drawings.

This invention relates to a log splitter including first support means having second support means, which supports one end of a log to be split, mounted thereon by first mounting means for movement of the second support means relative to the first support means. The log splitter has log splitting means engageable with the other end of the log to be split and mounted on the first support means by second mounting means. The second support means is moved by moving means from a start position toward the log splitting means to advance the log to be split relative to the log splitting means to cause the log splitting means to be driven into the log to be split to cause splitting thereof and to return the second support means to its start position upon completion of movement away from its start position. The log splitter has locking means to prevent movement of the log splitting means away from the second support means when the second support means is being moved from its start position toward the log splitting means while allowing movement with the log to be split of the log splitting means toward the second support means when the second support means returns to its start position.

The attached drawings illustrate preferred embodiments of the invention, in which.

Figure 1:
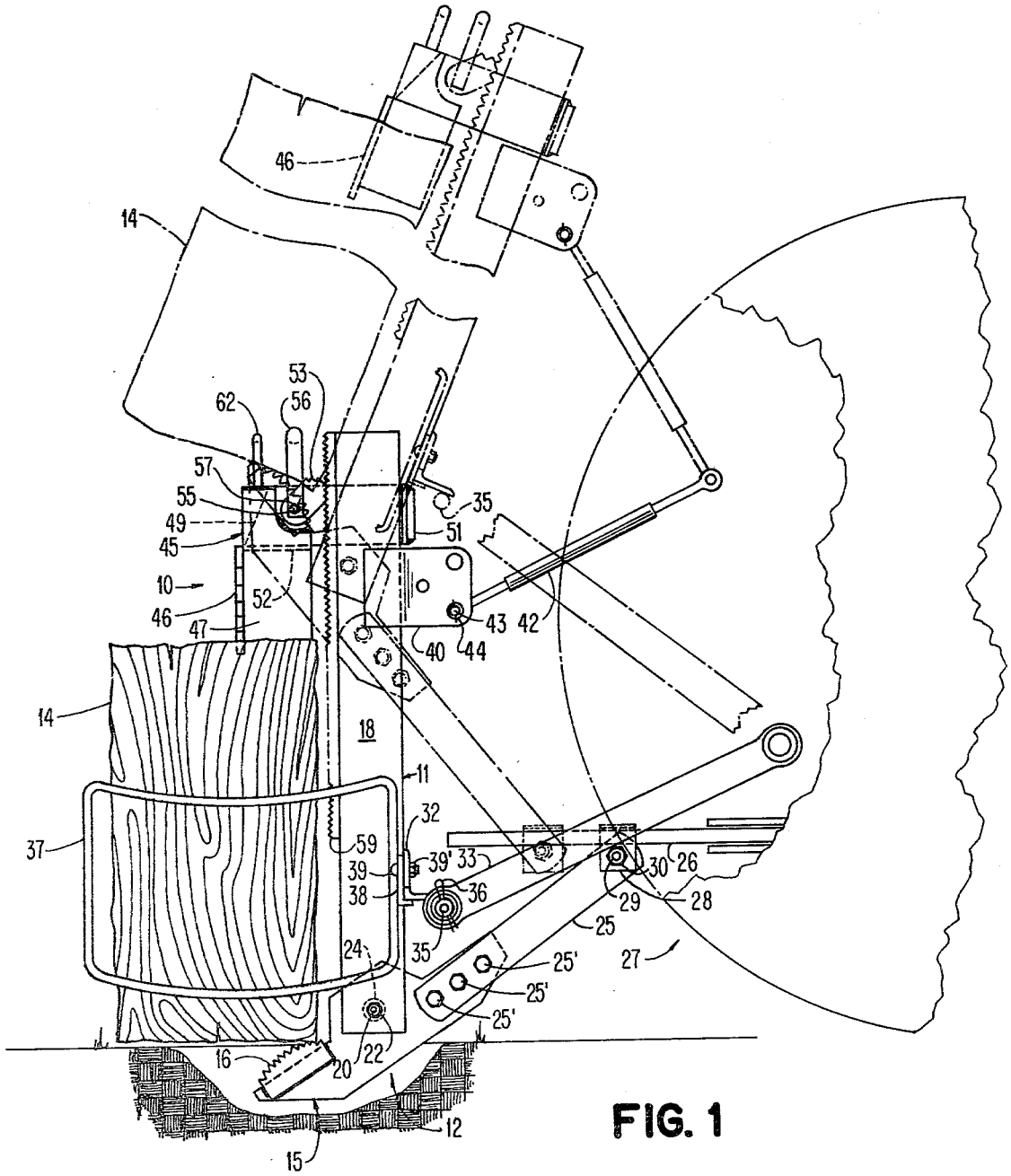
FIG. 1 is a side elevational view of one form of the log splitter of the present invention with the log splitter attached to a three point tractor hitch and the log splitter being shown in its start position in solid lines and at the completion of its upward movement in phantom lines.
Figure 2A:
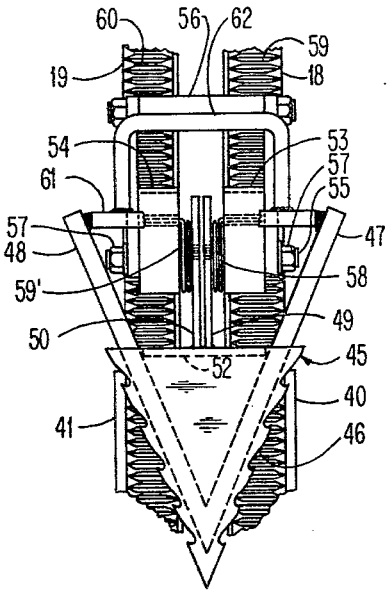
FIG. 2A is an enlarged rear elevational view of a portion of the log splitter.
Figure 2:
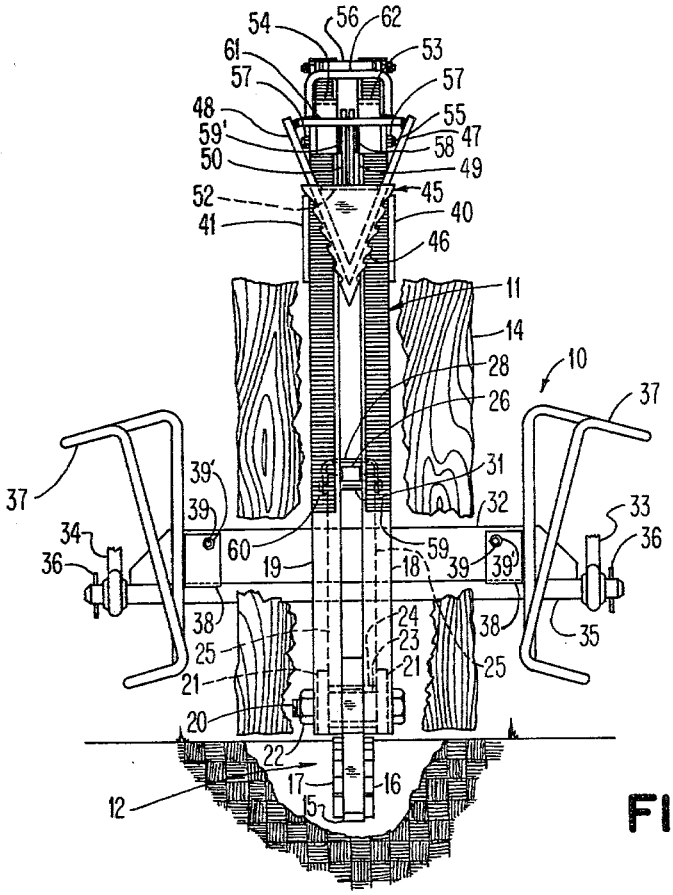
FIG. 2 is a rear elevational view of the log splitter of FIG. 1.
Figure 11:
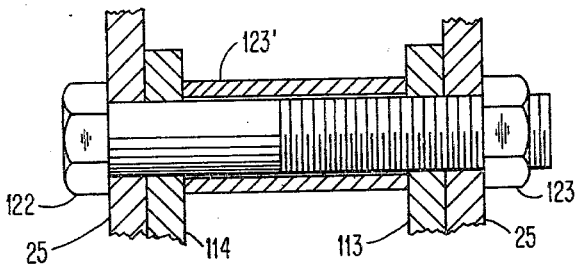
FIG. 11 is a fragmentary sectional view showing the connections of the log support beams to extensions connected to the tractor drawbar and taken along line 11—11 of FIG. 8.

Referring to the drawings and particularly FIGS. 1 and 2, there is shown a log splitter 10. The log splitter 10 includes vertical support means 11, which is disposed in a vertical position at the start of a log splitting cycle.

Bottom support means 12 for supporting the bottom of a log 14, which is to be split, is pivotally mounted adjacent the lower end of the vertical support means 11. The bottom support means 12 includes a log support beam 15, which has a pair of serrated elements 16 and 17 secured thereto adjacent one end thereof and on opposite sides thereof for engaging the bottom of the log 14.

The beam 15 extends between a pair of U-shaped channels 18 and 19 of the vertical support means 11. The beam 15 is pivotally connected to the vertical support means 11 by a bolt 20 extending through aligned openings in the beam 15, each of the channels 18 and 19 of the vertical support means 11, and a pair of plates 21, which are welded to the bottom of each of the channels 18 and 19 of the vertical support means 11. A nut 22 is attached to one end of the bolt 20. A bushing 23, which surrounds the bolt 20 and has its ends bearing against the plates 21, is surrounded by a tube 24, which is welded to the beam 15, so that the beam 15 is rotatably supported for pivotal movement.

The beam 15 has its end, which is remote from the serrated elements 16 and 17, connected by a pair of extensions 25 (one shown in FIG. 1 and two shown in FIG. 3) to a drawbar 26 of a tractor 27. The extensions 25 are connected to the beam 15 by screws 25' so that the extensions 25 are adjustable longitudinally relative to the beam 15.

Figure 3:
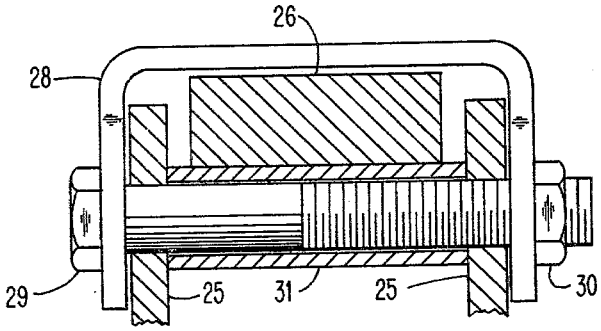
FIG. 3 is a fragmentary sectional view showing the connection of a beam, which supports the log to be split, to a tractor drawbar.

The extensions 25 are pivotally connected to a U-shaped slide 28 by a bolt 29 and a nut 30 (see FIG. 3). A bushing 31 surrounds the bolt 29 between the extensions 25 and slides along the bottom surface of the drawbar 26. Thus, the slide 28 can move from the solid line position to the phantom line position of FIG. 1 while the beam 15 pivots about the bolt 29 during movement of the vertical support means 11 of the log splitter 10 from its solid line position of FIG. 1 to its phantom line position.

An L-shaped bracket 32 is connected to a leg of each of the channels 18 and 19 of the vertical support means 11 by suitable means such as welding, for example. Lower links 33 and 34 of a three point hitch of the tractor 27, which has the drawbar 26, are pivotally connected adjacent the opposite ends of the L-shaped bracket 32 as shown in FIG. 2.

The bottom surface of the bottom leg of the L-shaped bracket 32 has a rod 35 welded thereto. Each of the links 33 and 34 is pivotally mounted on the rod 35 and retained thereon by suitable means such as pins 36 extending through openings at opposite ends of the rod 35.

The L-shaped bracket 32 has a guard rail 37 mounted adjacent each end thereof inboard of the pivotal connections of the links 33 and 34 of the three point hitch of the tractor 27 to the L-shaped bracket 32. The guard rails 37 prevent the log 14 from falling after it has been split.

Each of the guard rails 37 has a tab 38 welded thereto. Each of the tabs 38 is connected to the L-shaped bracket 32 by a bolt 39 and a nut 39' to removably connect the guard rail 37 to the L-shaped bracket 32.

The upper end of the vertical support means 11 has a horizontally extending plate 40 secured to the base of the U-shaped channel 18 and a horizontally extending plate 41 (see FIG. 4) secured to the base of the U-shaped channel 19. An upper link 42 (see FIG. 1) of the three point hitch of the tractor 27, which has the drawbar 26, is pivotally connected to the vertical support means 11 through the plates 40 and 41 (see FIG. 4). The link 42 is disposed between the plates 40 and 41 and has a pivot pin 43 extending through aligned openings in the plate 40, the end of the link 42, and the plate 41. A retaining pin 44 extends through an opening at each end of the pin 43, which rides in a bearing 44' in each of the plates 40 and 41, to hold the pin 43 in position.

Accordingly, the vertical support means 11 (see FIG. 1) of the log splitter 10 is pivotally connected to the three point hitch of the tractor 27, which has the drawbar 26. Thus, upward movement of the log splitter 10 occurs when the links 33, 34 (see FIG. 2), and 42 (see FIG. 1) of the three point hitch of the tractor 27 are pivoted upwardly.

A carrier 45, which is slidably mounted on the vertical support means 11, has a serrated V-shaped wedge 46 supported thereon for movement therewith. As shown in FIG. 2, the wedge 46 is attached to an edge of each of a pair of support plates 47 and 48 of the carrier 45. The support plates 47 and 48 are disposed at an angle to each other to form a V-shaped support for the V-shaped wedge 46. Each of the plates 47 and 48 has its surfaces, which enter the log 14 when the wedge 46 enters the log 14, sharpened.

The carrier 45 includes a pair of L-shaped brackets 49 (see FIG. 4) and 50 with the bracket 49 having its longer leg riding along the edges of the two legs of the U-shaped channel 18 and the bracket 50 having its longer leg riding along the edges of the two legs of the U-shaped channel 19. The shorter leg of each of the brackets 49 and 50 is secured to a connector 51 by suitable means such as welding, for example.

The brackets 49 and 50 extend rearwardly beyond the U-shaped channels 18 and 19 and have their lower surfaces secured by suitable means such as welding, for example to a horizontally disposed plate 52 (see FIGS. 1, 2, and 2A). The plate 52 extends between the support plates 47 and 48 of the carrier 45 and is secured to each by suitable means such as welding, for example.

The brackets 49 and 50 have a pair of pawls 53 and 54 pivotally mounted thereon. The pawls 53 and 54 are supported on a threaded rod 55, which extends through aligned openings in the brackets 49 and 50, for rotation therewith. The threaded rod 55 has a U-shaped handle 56 connected to each end thereof to enable pivotal movement of the pawls 53 and 54 together about the axis of the rod 55. A nut 57 is mounted on each end of the rod 55 to retain the handle 56 connected thereto.

The teeth of the pawl 53 are resiliently biased by a spring 58 (see FIG. 2A) into engagement with the teeth of a ratchet track 59, which is supported on the rear leg of the U-shaped channel 18. The teeth of the pawl 54 (see FIG. 2A) are resiliently biased by a spring 59' into engagement with the teeth of a ratchet track 60, which is mounted on the rear leg of the U-shaped channel 19 and substantially parallel to the ratchet track 59.

One end of each of the springs 58 and 59' passes through aligned openings, which are larger than the end of each of the springs 58 and 59' to accommodate both, in each of the brackets 49 and 50. The spring 58 has a few convolutions on the side of the bracket 49 and the spring 59' has a few convolutions on the side of the bracket 50. The other end of the spring 58 is disposed in a passage in the pawl 53, and the other end of the spring 59' is disposed in a passage in the pawl 54. Thus, the spring 58 continuously urges the teeth of the pawl 53 into engagement with the ratchet track 59 and the spring 59' continuously urges the teeth of the pawl 54 into engagement with the ratchet track 60 to retain the carrier 45 in a desired position on the vertical support means 11.

The inner surface of the upper end of each of the plates 47 and 48 is connected to a bar 61, which also is joined to the inclined rear end surface of each of the brackets 49 and 50. The bar 61 is secured to the plates 47 and 48 and the brackets 49 and 50 by suitable means such as welding, for example.

A U-shaped handle 62 has its ends disposed through holes in the bar 61 and secured thereto by suitable means such as welding, for example. The U-shaped handle 62 limits the rotation of the U-shaped handle 56 to pivot the pawls 53 and 54 so that their teeth are removed from engagement of with the ratchet tracks 59 and 60, respectively. The handles 56 and 62 are both grasped when the carrier 45 is to be moved by the user.

Considering the operation of the present invention, the log splitter 10 is disposed as shown in FIG. 1 with the ground preferably having a hole formed therein to receive a portion of the beam 15. Then, the log 14 is positioned adjacent the log splitter 10 so that the wedge 46 may be moved into contact with the top of the log 14 by removing the pawls 53 and 54 from engagement with the ratchet tracks 59 and 60, respectively, through turning the handle 56. With the wedge 46 engaging the top of the log 14, the handle 56 is released so that the pawls 53 and 54 have their teeth engage the teeth of the ratchet tracks 59 and 60 (see FIG. 2), respectively, due to the force of the springs 58 and 59', respectively.

Then, the three point hitch of the tractor 27 (see FIG. 1) is actuated. This causes pivoting of the vertical support means 11 during its upward movement as the links 33 and 34 (see FIG. 2) and 42 (see FIG. 1) of the three point hitch of the tractor 27 pivot clockwise about their pivotal connections to the tractor 27.

As this upward and pivotal movement of the vertical support means 11 occurs, the beam 15 pivots about the axis of the bolt 20 through the extensions 25 pivoting about the bolt 29 connected to the slide 28. As a result, additional portions of the serrated elements 16 and 17 (see FIG. 2) move into engagement with the bottom of the log 14 as upward movement of the vertical support means 11 occurs. It should be understood that a forward portion of each of the serrated elements 16 and 17 engages the bottom of the log 14 at the time that the log 14 is disposed in the position of FIG. 1. However, the pivoting of the beam 15 results in the portions of the serrated elements 16 and 17 (see FIG. 2) on the extreme rear end of the beam 15 moving into engagement with the bottom of the log 14 as shown in phantom in FIG. 1.

This changing of the portions of the serrated elements 16 and 17 (see FIG. 2) engaging the bottom of the log 14 changes the amplification of the force applied thereto. That is, as the portions of the serrated elements 16 and 17 on the extreme rear end of the beam 15 move into engagement, the force on the log 14 is being applied at the maximum distance of the serrated elements 16 and 17 from the fulcrum of the beam 15 at the axis of the bolt 20. Thus, the minimum amplification of the force applied to the beam 15 through movement of the three point hitch of the tractor 27 (see FIG. 1) is occurring at this time. When the initial application of the force is applied to the log 14, the distance from the engagement of the log 14 with the serrated elements 16 and 17 (see FIG. 2) to the axis of the bolt 20 is a minimum whereby the amplification of the applied force is a maximum. Therefore, this arrangement provides the maximum force on the log 14 at the start of the cycle, and the minimum force at the end of the upward movement of the vertical support means 11.

As the vertical support means 11 is moved upwardly and pivoted from the solid line position of FIG. 1 to the phantom line position of FIG. 1, the beam 15 pivots about the axis of the bolt 20. This causes upward movement of the log 14 into the wedge 46. Thus, the log 14 is driven into the wedge 46 rather than the wedge 46 being driven into the log 14.

At the completion of the upward movement of the vertical support means 11, the vertical support means 11 is returned to its start position through counterclockwise pivoting of the links 33, 34 (see FIG. 2), and 42 (see FIG. 1) of the three point hitch of the tractor 27. As a result, the log 14 remains in contact with the serrated elements 16 and 17 (see FIG. 2) on the beam 15 during downward movement of the vertical support means 11. This causes the log 14 to be moved downwardly relative to the vertical support means 11 by its weight during downward movement of the vertical support means 11. Since the wedge 46 is driven into the log 14 a predetermined distance during the upward movement of the vertical support means 11, the wedge 46 is held within the log 14 as the log 14 moves downwardly. This causes the wedge 46 to move downwardly by the teeth of the pawls 53 and 54 ratcheting over the teeth of the ratchet tracks 59 and 60, respectively.

Thus, during the next splitting cycle, the wedge 46 is already disposed within the log 14 to the distance to which the log 14 was advanced relative to the wedge 46 during the first splitting cycle. Therefore, when the vertical support means 11 is moved upwardly in the next splitting cycle, splitting of the log 14 begins from the position in which it ceased in the prior splitting cycle so that the maximum force exerted on the log 14 causes further splitting. Thus, the log 14 is advanced further relative to the wedge 46 during the second splitting cycle.

If this second splitting cycle does not result in the log 14 splitting, then a third splitting cycle would be necessary after the vertical support means 11 has returned to its start position. The wedge 46 again moves downwardly with the log 14 during the return of the vertical support means 11 to its start position with the wedge 46 being held in the log 14 at the position to which the log 14 was advanced relative to the wedge 46 during the third splitting cycle.

The number of the splitting cycles necessary depends upon many factors such as the type of wood of the log 14, the diameter and length of the log 14, any knots in the log 14, and any moisture in the log 14. After splitting of the log 14 has been completed, the wedge 46 can be quickly returned to a position above that in which the next of the logs 14 would be disposed. This is accomplished by turning the handle 56 to release the teeth of the pawls 53 and 54 from the teeth of the ratchet tracks 59 and 60, respectively, and lifting the carrier 45 by the handle 62.

Figure 4:
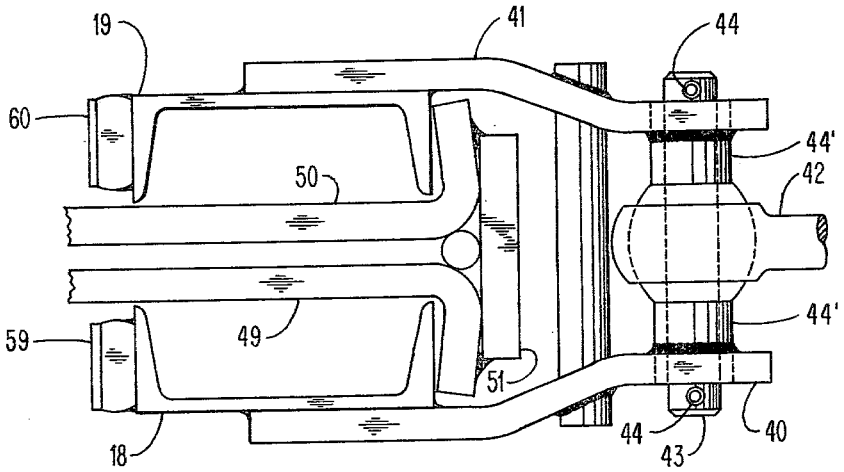
FIG. 4 is a top plan view of a portion of the wedge of the log splitter of the present invention and showing its mounting on the vertical support means.
Figure 5:
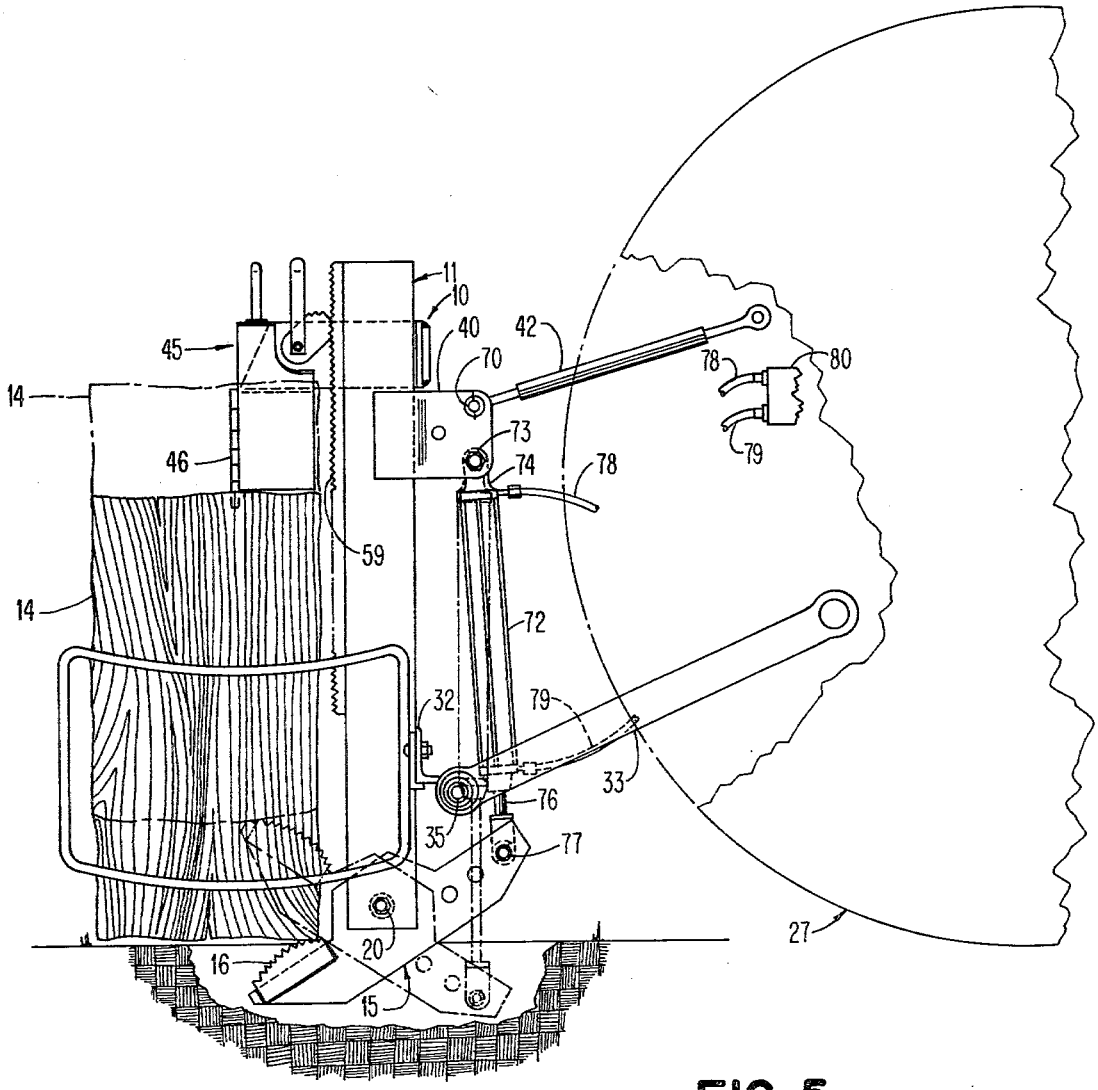
FIG. 5 is a side elevational view of another embodiment of the log splitter of the present invention in which a hydraulic cylinder provides the moving means with the splitter mounted on a tractor.

Referring to FIG. 5, there is shown another form of the invention in which the vertical support means 11 is stationary during the splitting cycles. The vertical support means 11 still has the lower links 33 and 34 (see FIG. 2) of the three point hitch of the tractor 27 (see FIG. 5) pivotally connected to the rod 35. While the upper link 42 of the three point hitch of the tractor 27 is still pivotally connected to the plates 40 and 41 (see FIG. 4), the link 42 (see FIG. 5) is pivotally connected by a pivot pin 70, which passes through upper aligned openings in the plates 40 and 41 (see FIG. 4) and is secured in the same manner as the pivot pin 43 (see FIG. 1). Thus, the log splitter 10 is still supported by the tractor 27.

A hydraulic cylinder 72 (see FIG. 5) is pivotally connected to the plates 40 and 41 (see FIG. 4) by a bolt 73 (see FIG. 5) extending through the lower aligned openings in the plates 40 and 41 (see FIG. 4) and a pair of ears (one shown at 74) on the upper end of the cylinder 72. The bolt 73 is secured by a nut (not shown). Thus, the upper end of the cylinder 72 is pivotally connected to the vertical support means 11.

The hydraulic cylinder 72 has a piston rod 76 extending therefrom. The lower end of the piston rod 76 is pivotally connected to the end of the beam 15 remote from the serrated elements 16 and 17 (see FIG. 2) by a pin 77 (see FIG. 5). The pin 77 is secured in the same manner as the pin 43.

The hydraulic cylinder 72 has fluid lines 78 and 79 connected to opposite ends thereof to allow pressurized fluid to be supplied to and removed from the cylinder 72 so as to act on a piston (not shown) to which the piston rod 76 is connected. That is, when the pressurized fluid is supplied through the line 78 to the cylinder 72 from a quick disconnect plug block 80, which has a pressurized fluid source on the tractor 27 connected thereto, and returned to the block 80 from the cylinder 72 through the line 79, the piston rod 76 is extended outwardly from the cylinder 72 to cause clockwise pivoting of the beam 15 about the bolt 20. This moves the beam 15 from the solid line position of FIG. 5 to the phantom line position of FIG. 5 whereby the serrated elements 16 and 17 (see FIG. 2) act against the bottom of the log 14 (see FIG. 5) to advance the log 14 into the wedge 46 to cause splitting of the log 14.

When the fluid from the block 80 is supplied to the cylinder 72 through the line 79 and returned to the block 80 from the cylinder 72 through the line 78, the piston rod 76 is retracted into the cylinder 72 to its solid line position of FIG. 5. This causes counterclockwise pivoting of the beam 15 about the bolt 20 whereby the log 14 moves downwardly with the beam 15. Since the wedge 46 is wedged in the log 14 to the extent that the log 14 has penetrated the wedge 46 during clockwise pivoting of the beam 15, the wedge 46 moves downwardly with the log 14 in the same manner as described for the embodiment of FIGS. 1–4.

Then, the splitting cycles repeat through extending and retracting the piston rod 76 of the cylinder 72 until the log 14 is split. Thereafter, another of the logs 14 would be disposed in the position shown in solid lines in FIG. 5.

Thus, in the embodiment of FIG. 5, there is no requirement for connection of the beam 15 to the drawbar 26 of the tractor 27. Instead, one end of the beam 15 is pivotally connected to the piston rod 76 of the hydraulic cylinder 72. As a result of this arrangement, it is not necessary for the vertical support means 11 to be moved. However, it is necessary for the vertical support means 11 to be supported in a substantially vertical position, and this is accomplished by the vertical support means 11 being connected to the links 33, 34 (see FIG. 2), and 42 (see FIG. 5) of the three point hitch of the tractor 27.

Figure 6:
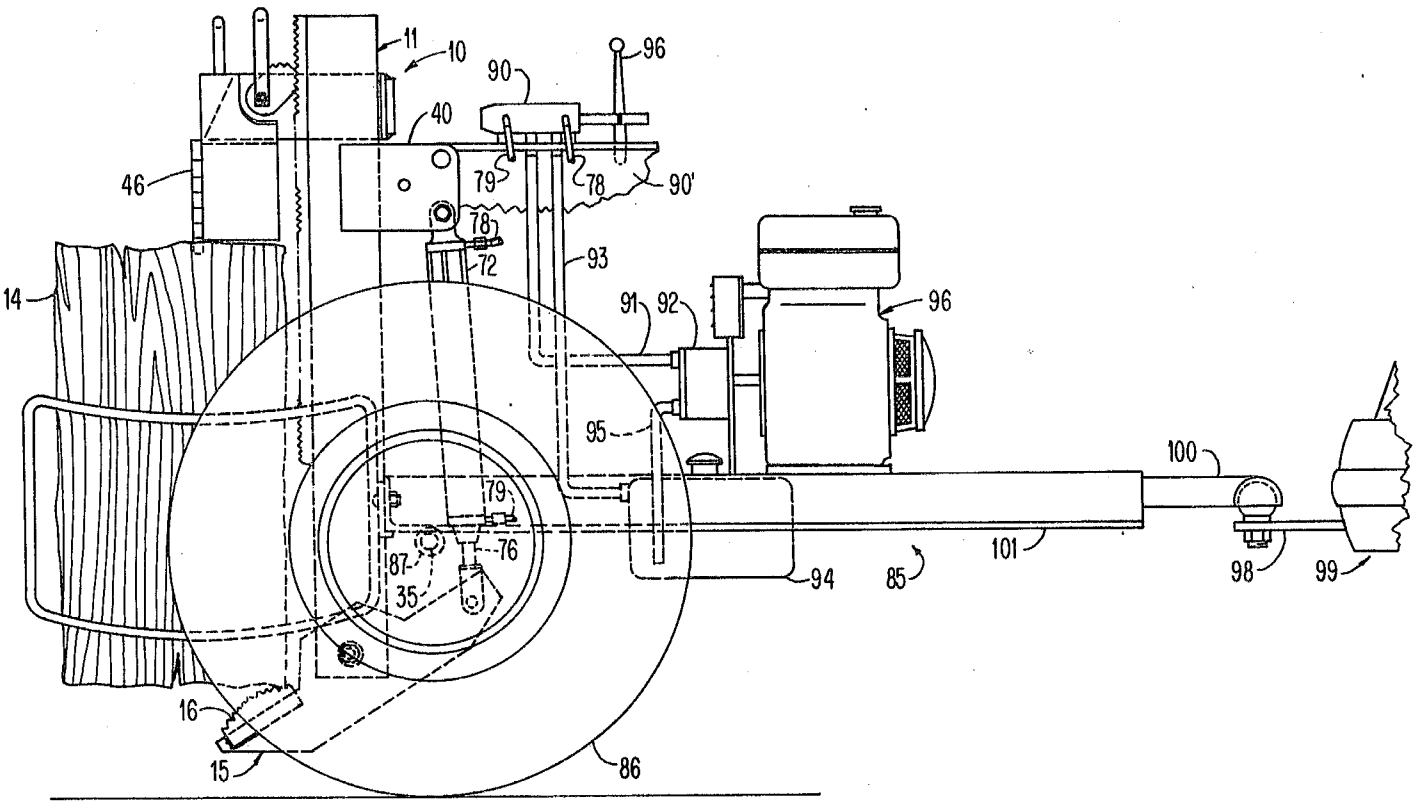
FIG. 6 is a side elevational view of a further modification of the log splitter of the present invention with the log splitter being mounted on a carrier and activated by a hydraulic cylinder.
Figure 7:
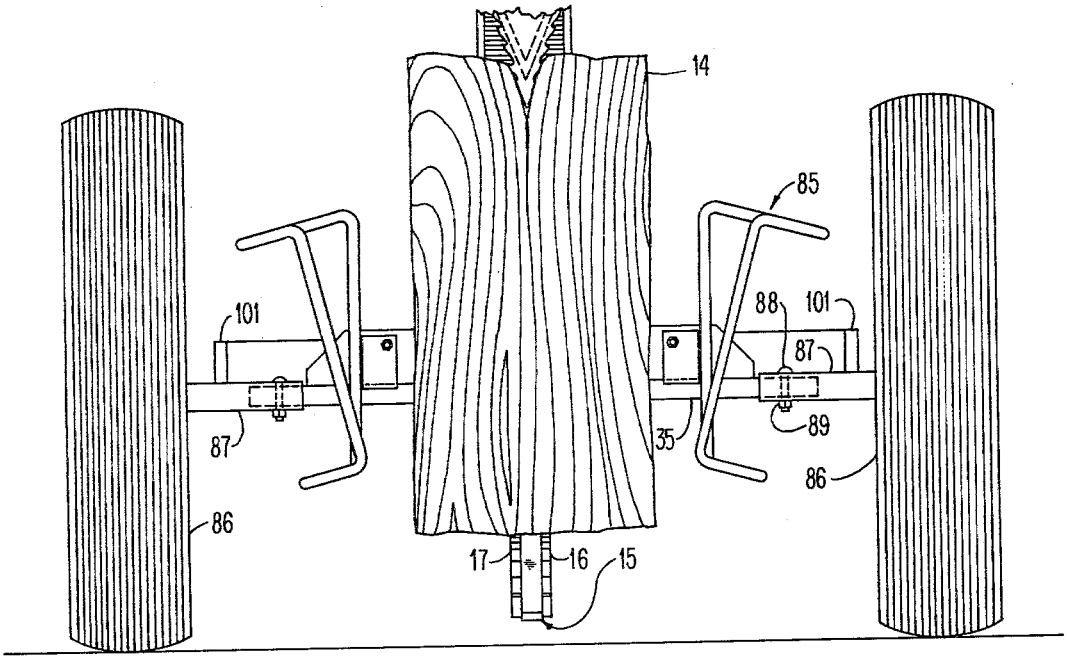
FIG. 7 is a rear elevational view of the log splitter of FIG. 6.

Referring to FIGS. 6 and 7, there is shown another form of the present invention in which the log splitter 10 is supported on a carrier 85, which includes a pair of wheels 86, rather than on the tractor 27. The log splitter 10 utilizes the hydraulic cylinder 72 and the piston rod 76 for pivoting the beam 15 in the same manner as described with respect to the embodiment of FIG. 5.

As shown in FIG. 7, each end of the rod 35, which previously had the links 33 and 34 pivotally connected thereto, is connected to an axle 87 of one of the wheels 86 of the carrier 85. The connection of each of the axles 87 to the rod 35 of the log splitter 10 is by a bolt 88 and a nut 89 with each of the bolts 88 passing through aligned openings in the rod 35 and the axle 87. The rod 35 extends into each of the axles 87 for support thereby.

The hydraulic fluid lines 78 (see FIG. 6) and 79 are connected to a valve housing 90, which is supported by a plate 90'; the plate 90' is carried between the plates 40 and 41 (see FIG. 4). A fluid line 91 (see FIG. 6) extends from the valve housing 90 to the outlet of a pump 92, which is mounted on the carrier 85. A fluid line 93 extends from the valve housing 90 to a reservoir or tank 94, which also is supported on the carrier 85. A fluid line 95 connects the reservoir 94 with the inlet of the pump 92.

Accordingly, when a handle 96, which controls the position of the valve within the valve housing 90 and is pivotally mounted on the plate 90', is in a first position, the pump 92 supplies pressurized fluid through the line 91, the valve housing 90, and the line 78 to the top of the hydraulic cylinder 72 to extend the piston rod 76. The fluid flows from the hydraulic cylinder 72 through the line 79, the valve housing 90, and the line 93 to the reservoir 94. This results in clockwise pivoting of the beam 15 to advance the log 14 into the wedge 46.

When the handle 96 is moved to a second position, the pump 92 supplies the pressurized fluid from the line 91 through the valve housing 90 and the line 79 to the bottom of the hydraulic cylinder 72. The hydraulic fluid flows from the top of the cylinder 72 through the line 78, the valve housing 90, and the line 93 to the reservoir 94. When this occurs, the piston rod 76 is retracted into the cylinder 72 to cause counterclockwise pivoting of the beam 15.

Thus, the extension and retraction of the piston rod 76 is the same as that described for the embodiment of FIG. 5. However, the carrier 85 has its own source of pressurized fluid rather than this being on the tractor 27.

In order to drive the pump 92, an engine 96 may be supported on the carrier 85. If desired, the pump 92 may be connected through flexible shafting (not shown) to the drive shaft of the tractor 27, for example.

The carrier 85 is connected to a hitch 98 of an automobile 99 through a trailer hitch 100 on the carrier 85 cooperating therewith. The trailer hitch 100 is supported at the apex of two frame portions 101, which are secured to the axles 87 of the wheels 86 and converge toward each other when viewed from above. Thus, the carrier 85 is moved by the automobile 99.

Referring to FIGS. 8–11, there is shown a log splitter 110. The log splitter 110 includes a vertical post or support 111, which comprises vertical support means and is disposed in a vertical position at the start of the log splitting cycle.

Figure 8:
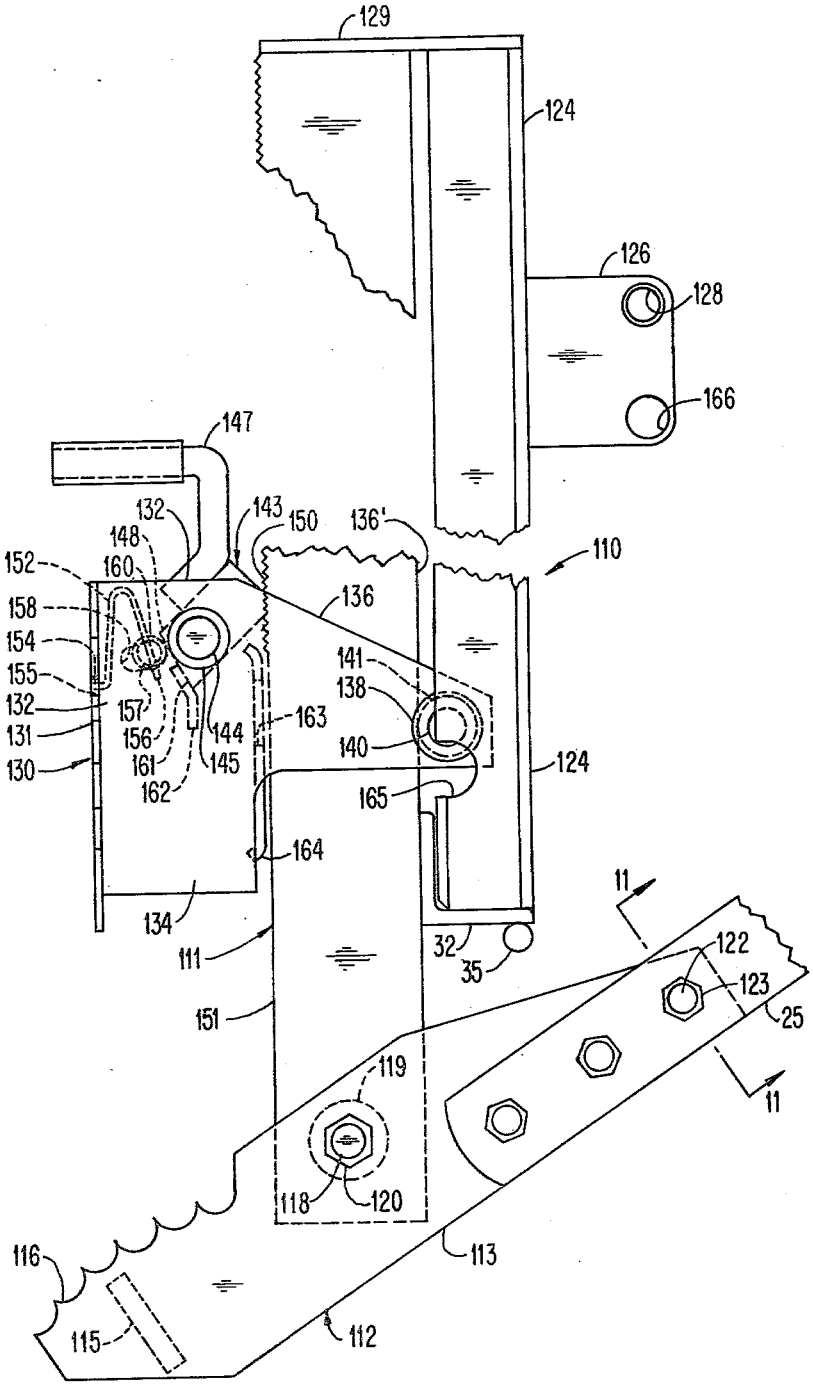
FIG. 8 is a side elevational view of another embodiment of the log splitter of the present invention.

Bottom support means 112 for supporting the bottom of the log 14 (see FIG. 1), which is to be split, is pivotally mounted adjacent the lower end of the post or support 111 (see FIG. 8). The bottom support means 112 includes a pair of log support beams 113 and 114 (see FIG. 9), which are secured to each other adjacent one end by a plate 115. The log support beams 113 and 114 have serrated elements 116 and 117, respectively, adjacent one end thereof for engaging the bottom of the log 14 (see FIG. 1).

The bottom support means 112 (see FIG. 8) is pivotally connected to the vertical post or support 111 by a bolt 118 (see FIG. 9) extending through aligned openings in the log support beams 113 and 114 and an opening in a tube 119, which is welded to the post or support 111 and extends therethrough. A nut 120 is attached to the end of the bolt 118. A bushing 121, which surrounds the bolt 118 and has its ends bearing against the log support beams 113 and 114, is surrounded by the tube 119 so that the log support beams 113 and 114 are rotatably supported for pivotal movement about the axis of the bolt 118.

Each of the beams 113 and 114 has its end, which is remote from the serrated elements 116 and 117, respectively, connected to the pair of extensions 25 (see FIG. 11) by a bolt 122 and a nut 123. A spacer 123' is disposed between the log support beams 113 and 114. The extensions 25 are connected to the drawbar 26 of the tractor 27 as previously shown and described with respect to FIGS. 1–3.

The vertical post or support 111 has the L-shaped bracket 32 connected thereto in the same manner as shown and described in the embodiment of FIGS. 1–3. The lower links 33 (see FIG. 9) and 34 of the three point hitch of the tractor 27 are pivotally connected to the opposite ends of the L-shaped bracket 32 by being mounted on the rod 35.

A pair of L-shaped brackets 124 (see FIGS. 8 and 10) and 125 (see FIG. 10) are welded to the L-shaped bracket 32 and extend upwardly therefrom. The upper end of each of the L-shaped brackets 124 and 125 has a plate 126 and 127, respectively, secured thereto. The plates 126 and 127 extend away from the vertical post or support 111. The upper link 42 (see FIG. 2) of the three point hitch on the tractor 27 is pivotally connected to the plates 126 (see FIG. 10) and 127 through having a pivot pin extend through an upper opening 128 (see FIG. 8) in the plate 126, a similar upper opening in the plate 127, and an opening in the end of the link 42 (see FIG. 2).

The upper ends of the brackets 124 (see FIG. 10) and 125 and the upper end of the post or support 111 are connected to each other by a horizontally disposed plate 129. The plate 129 is secured to the post or support 111 and the brackets 124 and 125 by suitable means such as welding, for example.

Accordingly, the vertical post or support 111 of the log splitter 110 is pivotally connected to the three point hitch of the tractor 27 (see FIG. 1). Thus, upward movement of the log splitter 110 (see FIG. 8) occurs when the links 33 (see FIG. 9), 34, and 42 (see FIG. 1) of the three point hitch of the tractor 27 are pivoted upwardly. This is in the same manner as described with respect to FIGS. 1–3.

Figure 9:
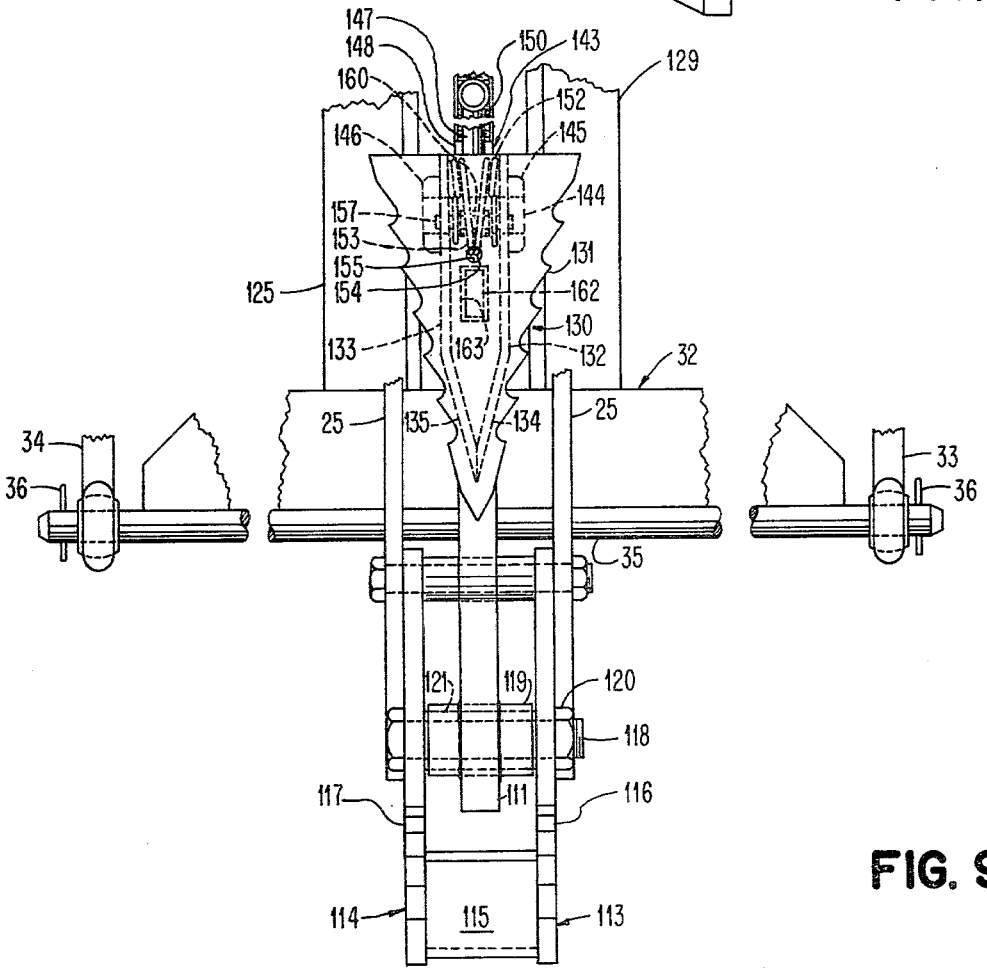
FIG. 9 is a rear elevational view of the log splitter of FIG. 8.

A carrier 130 (see FIGS. 8 and 9), which is slidably mounted on the vertical post or support 111, has a serrated V-shaped wedge 131 supported thereon for movement therewith. As shown in FIG. 9, the wedge 131 is attached to a rear edge of each of a pair of support plates 132 and 133 of the carrier 130.

The support plate 132 has its lower portion 134 disposed at the same angle as the adjacent side of the wedge 131 so as to be substantially parallel thereto. The support plate 133 has its lower portion 135 disposed at the same angle as the other side of the wedge 131 so as to be substantially parallel thereto. Each of the lower portions 134 and 135 is sharpened since they engage the log 14 during relative movement of the log 14 with respect to the carrier 130.

The support plate 132 has a portion 136 (see FIGS. 8 and 10) extending forwardly beyond front surface or edge 136' (see FIG. 8) of the vertical post or support 111. The support plate 133 has a similarly forwardly extending portion 137 (see FIG. 10) on the opposite side of the vertical post or support 111 from the portion 136 of the support plate 132. The portions 136 and 137 have collars 138 and 139 (see FIG. 10), respectively, secured thereto by suitable means such as welding, for example, to increase the bearing surfaces for a pin 140 (see FIGS. 8 and 10). The pin 140 is secured to one or both of the collars 138 and 139 (see FIG. 10) by set screws (not shown).

A roller 141 is rotatably mounted on the pin 140 and engages the forward surface or edge 136' of the vertical post or support 111 so as to ride therealong during movement of the carrier 130 along the vertical post or support 111. Thus, the roller 141 rotatably supports the carrier 130 on the forward edge 136' of the vertical post or support 111.

The support plates 132 and 133 of the carrier 131 have a pawl 143 (see FIGS. 8 and 9) pivotally supported thereby and therebetween. The pawl 143 is rotatably mounted on a pin 144, which extends through aligned openings in the support plates 132 and 133 and collars 145 and 146 (see FIG. 9). The collars 145 and 146 are mounted on the support plates 132 and 133, respectively, by suitable means such as welding, for example. The pawl 143 has a handle 147 (see FIG. 8) fixed to its surface 148 by suitable means such as welding, for example, to enable pivotal movement of the pawl 143 about the axis of the pin 144 when the handle 147 is turned.

The teeth of the pawl 143 are resiliently biased into engagement with the teeth of a ratchet track 150, which is formed along approximately the upper two-thirds of rear surface or edge 151 of the vertical post or support 111, by a pair of springs 152 and 153 (see FIG. 9). The spring 152 has its end 154 (see FIG. 8) disposed in a round opening 155 in the wedge 131. The spring 152 has a plurality of coils formed between the end 154 and its other end 156, which extends through an opening in a pin 157. The spring 153 is similarly formed.

The pin 157 extends through an elongated slot 158 in the support plate 132 and an elongated slot (not shown) in the support plate 133. A roller 160 is rotatably supported on the pin 157 between the springs 152 and 153 (see FIG. 9). The springs 152 and 153 hold the roller 160 in its longitudinal position on the pin 157 by being disposed on opposite sides of the roller 160 prior to extending through openings in the pin 157.

The roller 160 engages a surface 161 (see FIG. 8) of the pawl 143. The engagement of the surface of the roller 160 with the surface 161 of the pawl 143 resiliently urges the teeth of the pawl 143 into engagement with the teeth of the ratchet track 150.

When the teeth of the pawl 143 are moved out of engagement with the teeth of the ratchet track 150 by rotating the pawl 143 counterclockwise (as viewed in FIG. 8) about the axis of the pin 144 by turning the handle 147, the surface 161 of the pawl 143 cams along the roller 160 until an overcenter relation exists between the surface 161 and the roller 160. This overcenter relation causes the springs 152 and 153 to urge the pawl 143 counterclockwise about the axis of the pin 144 to move a stop 162, which is secured to the surface 161 of the pawl 143, into engagement with one of the teeth of the ratchet track 150 to lock the carrier 130 against movement. The stop 162, which also limits the amount of rotation of the pawl 143 by the handle 147 when it engages the ratchet track 150, extends through a rectangular shaped opening 163 in a plate 164, which extends between the support plates 132 and 133 and is secured thereto. The plate 164 slides along the teeth of the ratchet track 150 whenever the carrier 130 is moved downwardly by being engaged with the log 14 (see FIG. 1) after being wedged thereinto.

The plate 164 (see FIG. 8) has its bottom surfaces at the same angle as the portions 134 and 135 (see FIG. 9) of the support plates 132 and 133, respectively, since the plate 164 (see FIG. 8) extends therebetween. The plate 164 has these inclined side surfaces sharpened.

The L-shaped bracket 124 has a semi-circular cut out portion 165 formed therein adjacent its bottom end. The L-shaped bracket 125 (see FIG. 10) has a similar shaped semi-circular cut out portion 165' aligned with the cut out portion 165 (see FIG. 8) in the bracket 124. These enable the pin 140 to be passed through the openings in the collars 138 and 139 (see FIG. 10) and the roller 141 during assembly so as to slidably mount the carrier 130 on the vertical post or support 111.

Considering the operation of the log splitter 110 of FIGS. 8–11, the log 14 (see FIG. 1) is initially positioned on the serrated elements 116 (see FIGS. 8 and 9) and 117 (see FIG. 9) of the log support beams 113 and 114, respectively. Only the portions of the serrated elements 116 and 117 adjacent the post or support 111 initially engage the log 14 (see FIG. 1).

Then, the handle 147 (see FIG. 8) is turned to rotate the pawl 143 counterclockwise (as viewed in FIG. 8) about the axis of the pin 144 to remove the teeth of the pawl 143 from engagement with the teeth of the ratchet track 150. This enables the entire carrier 130 to move downwardly until the V-shaped wedge 131 has its bottom pointed end engage the top of the log 14 (see FIG. 1). The handle 147 (see FIG. 8) is then released so that the pawl 143 has its teeth engage the teeth of the ratchet 150 due to the force of the springs 152 and 153 (see FIG. 9).

Then, the three point hitch of the tractor 27 (see FIG. 1) is actuated. This causes pivoting of the vertical post or support 111 (see FIG. 8) during its upward movement as the links 33 (see FIGS. 1 and 2) and 34 and 42 of the three point hitch of the tractor 27 pivot clockwise about their pivotal connections to the tractor 27.

As this upward and pivotal movement of the vertical post or support 111 (see FIG. 8) occurs, the log support beams 113 and 114 (see FIG. 9) pivot about the axis of the bolt 118 through the extensions 25 (see FIG. 8) pivoting about the bolt 29 (see FIG. 3) connected to the slide 28. As a result, additional portions of the serrated elements 116 (see FIGS. 8 and 9) and 117 engage the bottom of the log 14 (see FIG. 1). This pivoting of the beams 113 (see FIGS. 8 and 9) and 114 results in portions of the serrated elements 116 and 117 on the extreme rear ends of the beams 113 and 114 moving into engagement with the bottom of the log 14 (see FIG. 1). The pivoting of the beams 113 (see FIGS. 8 and 9) and 114 causes upward movement of the log 14 (see FIG. 1) into the wedge 131 (see FIGS. 8 and 9) and the sharpened lower portions 134 and 135 of the support plates 132 and 133, respectively, along with the sharpened inclined bottom surfaces of the plate 164. Thus, the log 14 (see FIG. 1) is driven into the wedge 131 (see FIG. 8) rather than the wedge 131 being driven into the log 14 (see FIG. 1).

At the completion of the upward movement of the vertical post or support 111 (see FIG. 8), the vertical post or support 111 is returned to its start position in the same manner as described for the vertical support means 11 of FIGS. 1–4. As a result, the log 14 remains in contact with the serrated elements 116 (see FIGS. 8 and 9) and 117 on the log support beams 113 and 114, respectively, during downward movement of the vertical post or support 111. This causes the log 14 (see FIG. 1) to be moved downwardly relative to the vertical post or support 111 (see FIG. 8) by its weight during downward movement of the vertical post or support 111. Since the wedge 131 is driven into the log 14 (see FIG. 1) a predetermined distance during the upward movement of the vertical post or support 111 (see FIG. 8), the wedge 131 is held within the log 14 (see FIG. 1) as the log 14 moves downwardly. This causes the wedge 131 (see FIG. 8) to move downwardly by the teeth of the pawl 143 ratcheting over the teeth of the ratchet track 150.

Thus, during the next splitting cycle, the wedge 131 is already disposed within the log 14 (see FIG. 1) the distance to which the log 14 was advanced relative to the wedge 131 (see FIG. 8) during the first splitting cycle. Therefore, when the vertical post or support 111 is moved upwardly in the next splitting cycle, splitting of the log 14 (see FIG. 1) begins in the position in which it ceased in the prior splitting cycle.

After splitting of the log 14 has been completed by a number of the splitting cycles, the wedge 131 (see FIG. 8) can be quickly returned to a position above that in which the next of the logs 14 (see FIG. 1) would be disposed. This is accomplished by turning the handle 147 (see FIG. 8) to release the teeth of the pawl 143 from the teeth of the ratchet track 150 through counterclockwise (as viewed in FIG. 8) rotation of the pawl 143 about the axis of the pin 144 and lifting the carrier 130 by the handle 147. When the handle 147 is released, the teeth of the pawl 143 again return into engagement with the teeth of the ratchet track 150 because of the force of the springs 152 and 153 (see FIG. 9).

However, the handle 147 can be further turned to produce an overcenter relation of the surface 161 (see FIG. 8) of the pawl 143 to the roller 160 so that the springs 152 and 153 (see FIG. 9) cause the stop 162 (see FIG. 8) to engage the ratchet track 150 to lock the pawl 143 out of engagement with the ratchet track 150. This safety lock position insures that the pawl 143 remains in the position to which it is raised.

If the carrier 130 is in this safety lock position, it is then necessary to turn the handle 147 so that the pawl 143 rotates clockwise (as viewed in FIG. 8) until the teeth of the pawl 143 again engage the teeth of the ratchet track 150. At this time, the springs 152 and 153 (see FIG. 9) urge the teeth of the pawl 143 (see FIG. 8) into engagement with the teeth of the ratchet track 150. Thus, this would occur when another of the logs 14 (see FIG. 1) is supported on the log support beams 113 (see FIGS. 8 and 9) and 114 and is ready to have the wedge 131 moved into engagement therewith.

It should be understood that the log splitter 110 also can be actuated by the hydraulic cylinder 72 of FIG. 5 with the tractor 27 or the hydraulic cylinder 72 of FIGS. 6 and 7 utilized with the carrier 85. In either arrangement, one end of the hydraulic cylinder 72 would be connected to the plates 126 (see FIG. 10) and 127 by a pin extending through a lower opening 166 (see FIG. 8) in the plate 126 and an aligned lower opening (not shown) in the plate 127. The lower end of the piston rod 76 (see FIG. 5) of the hydraulic cylinder 72 would be connected to the end of each of the beams 113 (see FIGS. 8 and 9) and 114 by the pin 77 (see FIG. 5).

Figure 12:
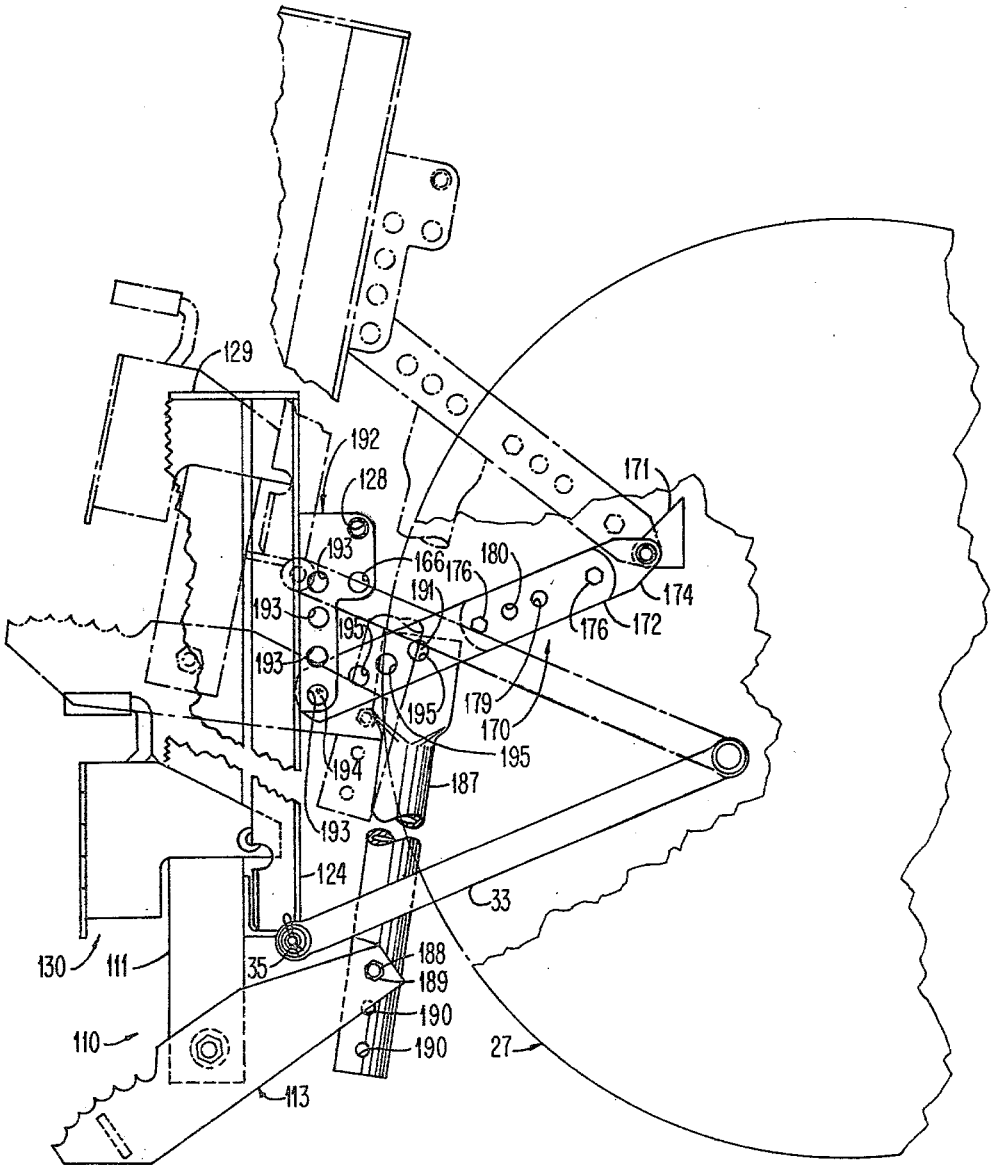
FIG. 12 is a side elevational view of the log splitter of FIGS. 8—11 having a different arrangement for actuation with some elements omitted for clarity purposes.

Referring to FIG. 12, there is shown an arrangement for mounting the log splitter 110 on the tractor 27 without the use of the drawbar 26. Thus, if the tractor 27 does not have the drawbar 26, this arrangement of FIG. 12 enables actuation of the log splitter 110.

In this arrangement of FIG. 12, the link 42 is replaced by an adjustable link 170, which is connected to two ears 171 (one shown) on the tractor 27 and to which the upper link 42 (see FIG. 1) of the three point hitch of the tractor 27 is pivotally connected. The adjustable link 170 (see FIGS. 12 and 13) includes a pair of outer plates 172 and 173 and a pair of inner plates 174 and 175.

The inner plates 174 and 175 are adjustably connected to the outer plates 172 and 173 by a pair of bolts 176 and cooperating nuts 177. Each of the outer plates 172 and 173 has four spaced holes 178, 179, 180, and 181 formed therein. Each of the inner plates 174 and 175 has four spaced holes 182, 183, 184, and 185 formed therein. The holes 178 are spaced the same distance from the holes 179 as the holes 185 are spaced from the holes 184. The spacing between the holes 179–181 is the same as the spacing of the holes 182–184.

Figure 13:
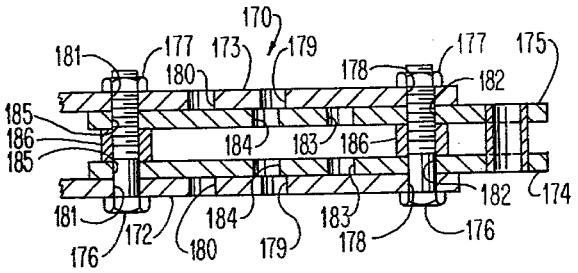
FIG. 13 is a fragmentary sectional view of the adjustable link of FIG. 12.

As shown in FIG. 13, one of the bolts 176 is extending through the holes 178 in the outer plates 172 and 173 and the holes 182 in the inner plates 174 and 175. The other of the bolts 176 is extending through the holes 181 in the outer plates 172 and 173 and the holes 185 in the inner plates 174 and 175. A spacer or sleeve 186 surrounds each of the bolts 176 between the inner plates 174 and 175.

The shortest length of the adjustable link 170 is shown in FIGS. 12 and 13. Thus, the inner plates 174 and 175 can be shifted relative to the outer plates 172 and 173 so that the holes 183 or the holes 184 in the inner plates 174 and 175 are aligned with the holes 178 in the outer plates 172 and 173 with the latter being the maximum extension of the adjustable link 170. In this maximum extended position, the other of the bolts 176 would pass through the holes 185 in the inner plates 174 and 175 and the holes 179 in the outer plates 172 and 173.

The link 170 has a connecting link 187 pivotally connected thereto and to each of the log support beams 113 and 114 (Only the log support beam 113 is shown in FIG. 12.). The connecting link 187 is disposed between the log support beams 113 and 114 and pivotally connected thereto by a bolt 188 extending through aligned openings in the connecting link 187 and the log support beams 113 and 114 and a nut 189 being secured to the bolt 188.

The connecting link 187 has two additional openings 190 beneath the opening through which the bolt 188 extends. This provides further adjustability of the connecting link 187 with respect to the log support beams 113 and 114.

The connecting link 187 is pivotally connected to the adjustable link 170 by a pin 191. The connecting link 187 is disposed between the two outer plates 172 and 173 (see FIG. 13) of the link 170.

The connecting link 187 (see FIG. 12) is formed of a hollow pipe, for example, having a flattened upper end disposed between the outer plates 172 and 173 (see FIG. 13) of the adjustable link 170 and a round portion disposed between the log support beams 113 and 114 (see FIG. 9). Each end of the hollow pipe could have a sleeve welded therein to provide an additional bearing surface for the bolt 188 (see FIG. 12) and the pin 191.

Figure 10:
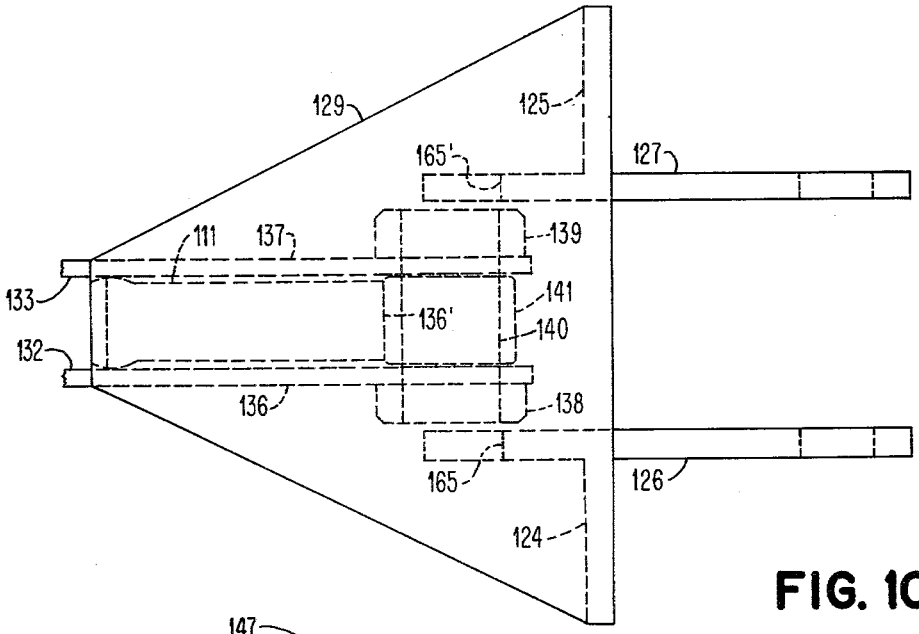
FIG. 10 is a top plan view of a portion of the log splitter of FIG. 8.

The adjustable link 170 is pivotally connected at its end to the vertical post or support 111 through a pair of plates 192 (one shown). The plates 192 replace the plates 126 and 127 of FIGS. 8 and 10 and are welded to the L-shaped brackets 124 and 125 (Only the L-shaped bracket 124 is shown in FIG. 12; the L-shaped bracket 125 is shown in FIG. 10.).

Each of the plates 192 (see FIG. 12) has the openings 128 and 166 therein in the same manner as they are formed in the plates 126 (see FIG. 10) and 127. There also are four vertically aligned openings 193 (see FIG. 12) in each of the plates 192 with the adjustable link 170 being pivotally connected to the plates 192 by a pin 194 extending through one of the openings 193 in each of the plates 192. The connection of the adjustable link 170 to the one of the openings 193 in each of the plates 192 is determined so that the link 170 is substantially parallel to the lower links 33 and 34 (see FIG. 2) at the start of the splitting cycle.

Each of the outer plates 172 and 173 (see FIG. 13) of the adjustable link 170 has two additional openings 195 (see FIG. 12) to receive the pin 191 for pivotally connecting the connecting link 187 thereto. The connection of the connecting link 187 to the next of the aligned openings 195 in the outer plates 172 and 173 (see FIG. 13) of the adjustable link 170 increases the power applied through the log support beams 113 (see FIG. 12) and 114 but reduces the travel. Similarly, the connection of the connecting link 187 to the leftmost of the aligned openings 195 in the outer plates 172 and 173 (see FIG. 13) of the adjustable link 170 creates more power but less travel.

When the links 33 and 34 (see FIG. 2) and the adjustable link 170 (see FIGS. 12 and 13) are rotated clockwise, the log support beams 113 and 114 pivot to the phantom line position of FIG. 12 while the vertical post or support 111 moves to the phantom line position of FIG. 12. This results in pivoting of the log support beams 113 and 114 in a manner similar to that previously described.

While the present invention has shown and described the log support beam 15 (see FIG. 1) as being pivotally mounted on the vertical support means 11 and the log support beams 113 (see FIG. 9) and 114 as being pivotally mounted on the vertical support 111, it should be understood that it is only necessary for there to be relative movement of the bottom support means 12 (see FIG. 1) with respect to the wedge 46 or the bottom support means 112 (see FIG. 8) with respect to the wedge 131 so as to produce relative movement therebetween whereby the log 14 (see FIG. 1) is driven into the wedge 46 or 131 (see FIG. 8). It also is necessary that the wedge 46 (see FIG. 1) or 131 (see FIG. 8) be capable of moving towards the bottom support means 12 (see FIG. 1) or 112 (see FIG. 8) after each movement of the log 14 (see FIG. 1) into the wedge 46 or 131 (see FIG. 8) has been completed while preventing movement of the wedge 46 (see FIG. 1) or 131 (see FIG. 8) when the log 14 (see FIG. 1) is being driven into the wedge 46 or 131 (see FIG. 8) by the movement of the bottom support means 12 (see FIG. 1) or 112 (see FIG. 8).

While the log splitter 10 (see FIG. 1) has been shown as being mounted on the tractor 27 or the carrier 85 (see FIG. 6), it should be understood that each of the embodiments of FIG. 5 and FIGS. 6 and 7 only requires means to support the vertical support means 11 while the bottom support means 12 (see FIG. 1) is moved relative to the wedge 46.

An advantage of this invention is that the log splitter may be readily utilized with an available tractor and without any external hydraulic source. Another advantage of this invention is that the amount of travel to start splitting of the log is reduced during each succeeding splitting cycle of the log. A further advantage of this invention is that the maximum force is applied at the start of each cycle.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. A log splitter including:

first support means;

second support means to support one end of a log to be split;

first mounting means to mount said second support means on said first support means for movement relative thereto;

said first mounting means including means to pivotally mount said second support means on said first support means;

log splitting means engageable with the other end of the log to be split;

second mounting means to mount said log splitting means on said first support means; moving means to move said second support means from a start position toward said log splitting means to advance the log to be split relative to said log splitting means to cause said log splitting means to be driven into the log to be split to cause splitting thereof and to return said second support means to its start position upon completion of movement away from its start position, said moving means moving said second support means independently of the position of said log splitting means;

locking means, operable independently of said moving means and separate from said moving means, to prevent movement of said log splitting means away from said second support means when said second support means is being moved from its start position toward said log splitting means while allowing movement with the log to be split of said log splitting means toward said second support means when said second support means returns to its start position;

said locking means including means to lock said log splitting means to said first support means during movement of said second support means toward said log splitting means;

said locking means including:

first means mounted on said first support means;

second means mounted on said log splitting means and engageable with said first means, said second means being supported solely by said log splitting means;

said first and second means having cooperating means to lock said second means to said first means against movement in the direction in which said log splitting means would be moved when said second support means is moved from its start position toward said log splitting means while allowing movement of said log splitting means when said second support means returns to its start position due to said log splitting means being wedged in the log being split;

said first means comprising at least one ratchet track;

and said second means comprising at least one spring biased pawl with the number of said pawls being equal to the number of said ratchet tracks and each of said pawls engaging a different one of said ratchet tracks;

said first support means including means for connection to each of the links of a three point hitch of a tractor to enable movement of said first support means by the three point hitch of the tractor, said first support means being vertically disposed when in its start position;

and said moving means including means to connect said second support means to a drawbar of the tractor to cause pivoting of said second support means relative to said first support means when said first support means is moved upwardly and downwardly by the three point hitch of the tractor to produce the sole source for movement of said second support means from its start position and return to its start position.

2. The log splitter according to claim 1 in which said first support means is moved from its vertical start position during movement of said first support means by the three point hitch of the tractor to produce pivoting of said second support means relative to said first support means while said second support means has its end connected by said connected means of said moving means to the drawbar of the tractor not only pivoting but also sliding along the drawbar.

3. The log splitter according to claim 1 in which:

said second support means includes a member;

said pivotal mounting means of said first mounting means is pivotally connected to said member of said second support means intermediate its ends to pivotally mount said member on said first support means;

said member being inclined to the horizontal in its start position;

said member having log engaging means on one end for engaging the bottom of the log to be supported thereby with said log engaging means being inclined to the horizontal at the same angle as said member;

said log engaging means having only its portion closest to the pivotal connection of said pivotal mounting means of said first mounting means to said member engaging the log when said second support means is in its start position with said log engaging means having the portion closest to the pivotal connection of said pivotal mounting means of said first mounting means to said member the uppermost portion of said log engaging means when said second support means is in its start position; and said log engaging means having portions progressively further from the pivotal connection of said pivotal mounting means of said first mounting means to said member engaging the log supported on said log engaging means as said member is pivoted by said moving means while the portions of said log engaging means closer to the pivotal connection of said pivotal mounting means of said first mounting means to said member cease to engage the log supported on said log engaging means.

4. A log splitter including:

first support means;

second support means to support one end of a log to be split;

first mounting means to mount said second support means on said first support means for movement relative thereto;

log splitting means engageable with the other end of the log to be split;

second mounting means to mount said log splitting means on said first support means;

moving means to move said second support means from a start position toward said log splitting means to advance the log to be split relative to said log splitting means to cause said log splitting means to be driven into the log to be split to cause splitting thereof and to return said second support means to its start position upon completion of movement away from its start position, said moving means moving said second support means independently of the position of said log splitting means;

locking means, operable independently of said moving means and separate from said moving means, to prevent movement of said log splitting means away from said second support means when said second support means is being moved from its start position toward said log splitting means while allowing movement with the log to be split of said log splitting means toward said second support means when said second support means returns to its start position;

said first support means including means for connection to each of the links of a three point hitch of a tractor to enable movement of said first support means by the three point hitch of the tractor, said first support means being vertically disposed when in its start position; and said moving means including means to connect said second support means to a drawbar of the tractor to cause movement of said second support means relative to said first support means when said first support means is moved upwardly and downwardly by the three point hitch of the tractor to produce the sole source for movement of said second support means from its start position and return to its start position.

5. The log splitter according to claim 4 in which said first support means is moved from its vertical start position during movement of said first support means by the three point hitch of the tractor to produce pivoting of said second support means relative to said first support means while said second support means has its end connected by said connected means of said moving means to the drawbar of the tractor not only pivoting but also sliding along the drawbar.

6. The log splitter according to claim 4 in which:

said first mounting means includes means to pivotally mount said second support means on said first support means;

said second support means includes a member;

said pivotal mounting means of said first mounting means is pivotally connected to said member of said second support means intermediate its ends to pivotally mount said member on said first support means;

said member being inclined to the horizontal in its start position;

said member having log engaging means on one end for engaging the bottom of the log to be supported thereby with said log engaging means being inclined to the horizontal at the same angle as said member;

said log engaging means having only its portion closest to the pivotal connection of said pivotal mounting means of said first mounting means to said member engaging the log when said second support means is in its start position with said log engaging means having the portion closest to the pivotal connection of said pivotal mounting means of said first mounting means to said member the uppermost portion of said log engaging means when said second support means is in its start position; and said log engaging means having portions progressively further from the pivotal connection of said pivotal mounting means of said first mounting means to said member engaging the log supported on said log engaging means as said member is pivoted by said moving means while the portions of said log engaging means closer to the pivotal connection of said pivotal mounting means of said first mounting means to said member cease to engage the log supported on said log engaging means.

7. A log splitter including:

first support means;

second support means to support one end of a log to be split;

first mounting means to mount said second support means on said first support means for movement relative thereto;

said first mounting means including means to pivotally mount said second support means on said first support means;

log splitting means engageable with the other end of the log to be split;

second mounting means to mount said log splitting means on said first support means;

moving means to move said second support means from a start position toward said log splitting means to advance the log to be split relative to said log splitting means to cause said log splitting means to be driven into the log to be split to cause splitting thereof and to return said second support means to its start position upon completion of movement away from its start position, said moving means moving said second support means independently of the position of said log splitting means;

locking means, operable independently of said moving means and separate from said moving means, to prevent movement of said log splitting means away from said second support means when said second support means is being moved from its start position toward said log splitting means while allowing movement with the log to be split of said log splitting means toward said second support means when said second support means returns to its start position; and said second support means including means disposed at an angle to the horizontal when said second support means is in its start position, said disposed means including serrated elements on one end for engaging the bottom of the log to be lifted, said disposed means being disposed so that only the portions of said serrated elements closest to the axis of said pivotal mounting means of said first mounting means engage the log when said second support means is in its start position, and the portions of said serrated elements progressively further from the pivot axis of said pivotal mounting means of said first mounting means engaging the bottom of the log as said second support means is moved from its start position with only the portions of said serrated elements most remote from the pivot axis of said pivotal mounting means of said first mounting means engaging the log at the completion of movement of said second support means from its start position.

8. A log splitter including:

first support means;

second support means to support one end of a log to be split;

first mounting means to mount said second support means on said first support means for movement relative thereto;

said first mounting meand including means to pivotally mount said second support means on said first support means;

log splitting means engageable with the other end of the log to be split;

second mounting means to mount said log splitting means on said first support means;

moving means to move said second support means from a start position toward said log splitting means to advance the log to be split relative to said log splitting means to cause said log splitting means to be driven into the log to be split to cause splitting thereof and to return said second support means to its start position upon completion of movement away from its start position, said moving means moving said second support means independently of the position of said log splitting means;

locking means, operable independently of said moving means and separate from said moving means, to prevent movement of said log splitting means away from said second support means when said second support means is being moved from its start position toward said log splitting means while allowing movement with the log to be split of said log splitting means toward said second support means when said support means returns to its start position;

said second support means including a member;

said pivotal mounting means of said first mounting means being pivotally connected to said member of said second support means intermediate its end to pivotally mount said member on said first support means;

said member being inclined to the horizontal in its start position;

said member having log engaging means on one end for engaging the bottom of the log to be supported thereby with said log engaging means being inclined to the horizontal at the same angle as said member;

said log engaging means having only its portion closest to the pivotal connection of said pivotal mounting means of said first mounting means to said member engaging the log when said second support means is in its start position with said log engaging means having the portion closest to the pivotal connection of said pivotal mounting means of said first mounting means to said member as the uppermost portion of said log engaging means when said second support means is in its start position; and said log engaging means having portions progressively further from the pivotal connection of said pivotal mounting means of said first mounting means to said member engaging the log supported on said log engaging means as said member is pivoted by said moving means while the portions of said log engaging means closer to the pivotal connection of said pivotal mounting means of said first mounting means to said member cease to engage the log supported on said log engaging means.

* * * * *

UNITED STATES PATENT AND TRADEMARK OFFICE

CERTIFICATE OF CORRECTION

PATENT NO. : 4,199,015

DATED : April 22, 1980

INVENTOR(S) : Charles W. Doering

It is certified that error appears in the above—identified patent and that said Letters Patent is hereby corrected as shown below:

Column 4, line 58, after "example" insert a --comma (,) --.

Column 5, line 37, cancel "of"

Column 15, line 60, "moving" should be the start of a sub-paragraph.

Column 19, line 53, "meand" should be --means--.

Signed and Sealed this

*Fifteenth* Day of *July 1980*

[SEAL]

*Attest:*

SIDNEY A. DIAMOND

*Attesting Officer*

*Commissioner of Patents and Trademarks*